US008122549B2

(12) United States Patent
Park et al.

(10) Patent No.: US 8,122,549 B2
(45) Date of Patent: Feb. 28, 2012

(54) WASHING MACHINE AND CONTROL METHOD OF MAINTAINING A BALANCED STATE OF LAUNDRY THEREOF

(75) Inventors: Chang Joo Park, Seoul (KR); Soon Bae Yang, Seongnam-si (KR); Jung Chul Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 970 days.

(21) Appl. No.: 12/078,653

(22) Filed: Apr. 2, 2008

(65) Prior Publication Data

US 2008/0289118 A1 Nov. 27, 2008

(30) Foreign Application Priority Data

May 21, 2007 (KR) ..... 10-2007-0049266
Aug. 29, 2007 (KR) ..... 10-2007-0086874

(51) Int. Cl.
*D06F 33/02* (2006.01)

(52) U.S. Cl. ..... 8/159; 68/12.06

(58) Field of Classification Search ..... 8/158–159; 68/12.06, 23.1, 23.2
See application file for complete search history.

(56) References Cited

U.S. PATENT DOCUMENTS 4,517,695 A 5/1985 Hoffmann et al.
(Continued)

FOREIGN PATENT DOCUMENTS

DE 31 41 901 5/1983
EP 1 045 062 10/2000
(Continued)

OTHER PUBLICATIONS

Extended European Search Report for corresponding European Application 08153279.8-2314.

*Primary Examiner* — Joseph L Perrin
(74) *Attorney, Agent, or Firm* — Staas & Halsey LLP

(57) ABSTRACT

Disclosed herein are a washing machine that is capable of maintaining the balanced state of laundry to more smoothly perform a spin-drying operation and a control method thereof. The control method of the washing machine including a drum to receive laundry and a motor to rotate the drum to reduce unbalance generated due to the nonuniform distribution of the laundry, includes wrapping the laundry by accelerating the drum such that the laundry sticks to an inner wall of the drum, detecting motor current during the wrapping of the laundry, determining an unbalanced state of the laundry based on the detected motor current, and controlling speed of the drum based on a result of the determination.

11 Claims, 18 Drawing Sheets

U.S. PATENT DOCUMENTS

| | | | | |
|---|---|---|---|---|
| 5,671,494 | A | 9/1997 | Civanelli et al. | |
| 6,240,586 | B1 * | 6/2001 | Joo | 8/159 |
| 2006/0021392 | A1 * | 2/2006 | Hosoito et al. | 68/12.04 |
| 2006/0185095 | A1 * | 8/2006 | Mitts | 8/158 |
| 2007/0039106 | A1 * | 2/2007 | Stansel et al. | 8/159 |

FOREIGN PATENT DOCUMENTS

| | | |
|---|---|---|
| EP | 1 561 851 | 8/2005 |
| EP | 1 693 498 | 8/2006 |
| FR | 2 311 883 | 12/1976 |
| JP | 09-290089 | 11/1997 |

* cited by examiner

RELATED ART

WASHING MACHINE AND CONTROL METHOD OF MAINTAINING A BALANCED STATE OF LAUNDRY THEREOF

CROSS-REFERENCE TO RELATED APPLICATIONS

This application claims the benefit of Korean Patent Application No. 2007-49266, filed on May 21, 2007 and No. 2007-86874, filed on Aug. 29, 2007 in the Korean Intellectual Property Office, the disclosure of which is incorporated herein by reference.

BACKGROUND

1. Field

The present invention relates to a washing machine and a control method thereof, and, more particularly, to a washing machine that is capable of maintaining the balanced state of laundry to more smoothly perform a spin-drying operation and a control method thereof.

2. Description of the Related Art

Generally, a washing machine (normally, a drum-type washing machine) is a machine, including a water tub to receive water (wash water or rinse water), a cylindrical drum rotatably mounted in the water tub to receive laundry, and a motor to generate a drive force necessary to rotate the drum, that washes the laundry by lifting and dropping the laundry in the drum along the inner wall of the drum during the rotation of the drum.

The washing machine performs laundry cleaning through a washing operation of removing contaminants from laundry with water containing detergent dissolved therein (specifically, wash water), a rinsing operation of removing bubbles or remaining detergent from the laundry with water containing no detergent (specifically, rinse water), and a spin-drying operation of spin-drying the laundry at a high speed. For the spin-drying operation, as shown in FIG. 1, when a drum 10 is rotated at a high speed while laundry 12 is nonuniformly distributed along the inner wall of the drum 10, i.e., the laundry 12 is unbalanced, an eccentric force is applied to a rotary shaft of the drum 10, with the result that large vibration occurs.

In order to prevent the occurrence of the vibration due to the unbalanced state of the laundry, it is necessary to perform a process to uniformly distribute the laundry 12 in the drum 10, as shown in FIG. 2, before the spin-drying operation. This is because, when the spin-drying operation is performed in the unbalanced state of the laundry, the spin-drying time may be increased, and spin-drying errors may occur. In addition, when the laundry 12 is removed from the washing machine after the completion of the laundry cleaning, a large amount of force is required because the laundry is tangled, which causes dissatisfaction of main users.

In order to solve this problem, an unbalance reduction control procedure is performed to maintain the balanced state of the laundry 12 in the conventional art. As shown in FIG. 3, the unbalance reduction control procedure includes a laundry untangling process ① to untangle the tangled laundry 12 by rotating the drum 10 in alternating directions when a spin-drying operation is initiated, a laundry wrapping process ②-1 to attach the laundry 12 to an inner wall of the drum 10 by rotating the drum 10 at predetermined speeds rpm 1 and rpm 2, a laundry amount detecting process ③ to estimate a weight of the laundry 12, an unbalance detecting process ④ to estimate an unbalance size in the drum 10 using the estimated weight information and a control variable, such as a speed ripple or a current ripple, and a high-speed spin-drying process ⑤ to discharge moisture contained in the laundry 12 outside using a centrifugal force caused by rotating the drum 10 at a high speed when the estimated unbalance size is within an allowable value. These processes are sequentially performed. When the estimated unbalance size is greater than the allowable value, on the other hand, the procedure returns to the laundry untangling process ① and then the unbalance reduction control procedure is repeated.

In the laundry wrapping process ②-1, the rotation speed is accelerated from the first rotation speed rpm1 to the second rotation speed rpm2, which is greater than a speed at which the laundry 12 sticks to the inner wall of the drum 10, and the state of the laundry 12 is not considered during the increase of the rotation speed of the drum 10 to the rpm2. For a load such as a small amount of laundry 12 or blue jeans, the balance of which is difficult to maintain, the unbalance is great, even after the laundry wrapping process ② is completed. As a result, it is not possible to rotate the drum 10 at a high speed, and the laundry untangling process ① may be reperformed. On the assumption that a probability of maintaining the balance through the laundry wrapping process ②-1 is 10%, and time required to perform the procedure from the laundry untangling process ① to the unbalance detecting process ④ is 1 minute, for example, the balance is maintained after the unbalance reduction control procedure is performed 10 times on average, and therefore, it takes approximately 10 minutes until the high-speed spin-drying process is initiated. This spin-drying time is excessive.

SUMMARY

Therefore, it is an aspect of the embodiments to provide a washing machine that is capable of reducing unbalance reduction control time to maintain the balanced state of laundry through an improved laundry wrapping process, thereby reducing a total spin-drying time, and a control method thereof.

It is another aspect of the invention to provide a washing machine that is capable of determining the unbalanced state of laundry in real time during a laundry wrapping process, and, when the laundry is unbalanced, reperforming only the laundry wrapping process to greatly improve a laundry wrapping success rate, thereby greatly reducing a total unbalance reduction control time, and a control method thereof.

Additional aspects and/or advantages will be set forth in part in the description which follows and, in part, will be apparent from the description, or may be learned by practice of the invention.

The foregoing and/or other aspects are achieved by providing a control method of a washing machine including a drum to receive laundry and a motor to rotate the drum to reduce unbalance generated due to the nonuniform distribution of the laundry, including wrapping the laundry by accelerating the drum such that the laundry sticks to an inner wall of the drum, detecting motor current during the wrapping of the laundry, determining whether the laundry is in an unbalanced state or a balanced state based on the detected motor current, and controlling speed of the drum based on the result of the determination.

The wrapping the laundry may include accelerating the speed of the drum by stages to reduce the unbalance of the laundry before a high-speed spin-drying operation.

The accelerating the drum may include accelerating the speed of the drum by stages, and controlling the speed of the drum accelerated by stages based on the detected motor current.

The speed of the drum may include a first rotation speed at which the laundry does not stick to the inner wall of the drum, a second rotation speed at which the laundry sticks to the inner wall of the drum, the second rotation speed being higher than the first rotation speed, and a third rotation speed at which the laundry starts to stick to the inner wall of the drum, the third rotation speed being between the first rotation speed and the second rotation speed.

The detecting motor current may include detecting a magnitude of the motor current when the speed of the drum exceeds the third rotation speed at an operation at which the speed of the drum is accelerated from the first rotation speed to the second rotation speed.

The controlling the speed of the drum may include reperforming the laundry wrapping operation by accelerating the speed of the drum from the first rotation speed, when it is determined that the laundry is in the unbalanced state.

The controlling the speed of the drum may include performing a high-speed spin-drying operation by continuously accelerating the speed of the drum, when it is determined that the laundry is in the balanced state.

The determining whether the laundry is in the unbalanced state or the balanced state may include searching for a minimum value of the detected motor current to compare the minimum value of the motor current to a predetermined current limit value, and determining that the laundry is in the unbalanced state, when the minimum value of the motor current is less than the predetermined current limit value.

The minimum value of the motor current may be a minimum current value at an operation at which the speed of the drum is accelerated from the third rotation speed to the second rotation speed.

The foregoing and/or other aspects are achieved by providing a control method of a washing machine including a drum to receive laundry and a motor to rotate the drum to reduce unbalance generated due to the nonuniform distribution of the laundry, including wrapping the laundry by accelerating the drum such that the laundry sticks to an inner wall of the drum, determining an unbalanced state of the laundry using duty information applied to the motor during the wrapping of the laundry, and controlling speed of the drum based on a result of the determination.

The determining the unbalanced state of the laundry may include calculating a size of a reference duty during the acceleration of the drum to determine the difference between an actual duty applied to the motor and the reference duty, generating an unbalance determination signal from a minimum value of the difference between the actual duty and the reference duty to compare the unbalance determination signal to a predetermined unbalance limit value, and determining that the laundry is in the unbalanced state when the minimum value of the difference between the actual duty and the reference duty is less than the unbalance limit value.

The foregoing and/or other aspects are achieved by providing a washing machine including a drum to receive laundry, a motor rotating the drum, and a control unit controlling speed of the drum based on a result of a determination as to whether the laundry is in an unbalanced state or a balanced state, by detecting motor current during an acceleration of the drum.

The control unit may perform a laundry wrapping operation to reduce an unbalance of the laundry, by accelerating the speed of the drum by stages, before a high-speed spin-drying operation.

The control unit may control the speed of the drum accelerated by stages based on the detected motor current.

The control unit may store a first rotation speed at which the laundry does not stick to an inner wall of the drum, a second rotation speed at which the laundry sticks to the inner wall of the drum, the second rotation speed being higher than the first rotation speed, and a third rotation speed at which the laundry starts to stick to the inner wall of the drum, the third rotation speed being between the first rotation speed and the second rotation speed.

The control unit may detect a magnitude of the motor current when the speed of the drum exceeds the third rotation speed at an operation at which the speed of the drum is accelerated from the first rotation speed to the second rotation speed.

The control unit may search for a minimum value of the detected motor current to compare the minimum value of the motor current to a predetermined current limit value, and determines that the laundry is in the unbalanced state when the minimum value of the motor current is less than the predetermined current limit value.

The control unit may reperform the laundry wrapping operation by accelerating the speed of the drum from the first rotation speed, when it is determined that the laundry is in the unbalanced state.

The control unit may perform a high-speed spin-drying operation by continuously accelerating the speed of the drum, which is being accelerated to the second rotation speed, when it is determined that the laundry is in the balanced state.

The foregoing and/or other aspects are achieved by providing a washing machine including a drum to receive laundry, a motor rotating the drum, and a control unit controlling speed of the drum based on a result of a determination as to an unbalanced state of the laundry using duty information applied to the motor during an acceleration of the drum.

The foregoing and/or other aspects are achieved by providing a control method for a washing machine including a drum to receive laundry and a motor rotating the drum, including: accelerating the drum such that the laundry sticks to an inner wall of the drum to wrap the laundry; determining whether the laundry is in an unbalanced or a balanced state during the wrapping of the laundry; and reperforming the wrapping of the laundry when the laundry is in the unbalanced state.

The determining whether the laundry is in the unbalanced or the balanced state during the wrapping of the laundry may include detecting a magnitude of motor current flowing at a moment at which a rotation speed of the drum exceeds a rotation speed at which the laundry starts to stick to the inner wall of the drum and comparing the detected magnitude of motor current with an unbalance current limit value to determine whether the laundry is in the unbalanced or the balanced state.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF THE EMBODIMENTS

Figure 1:
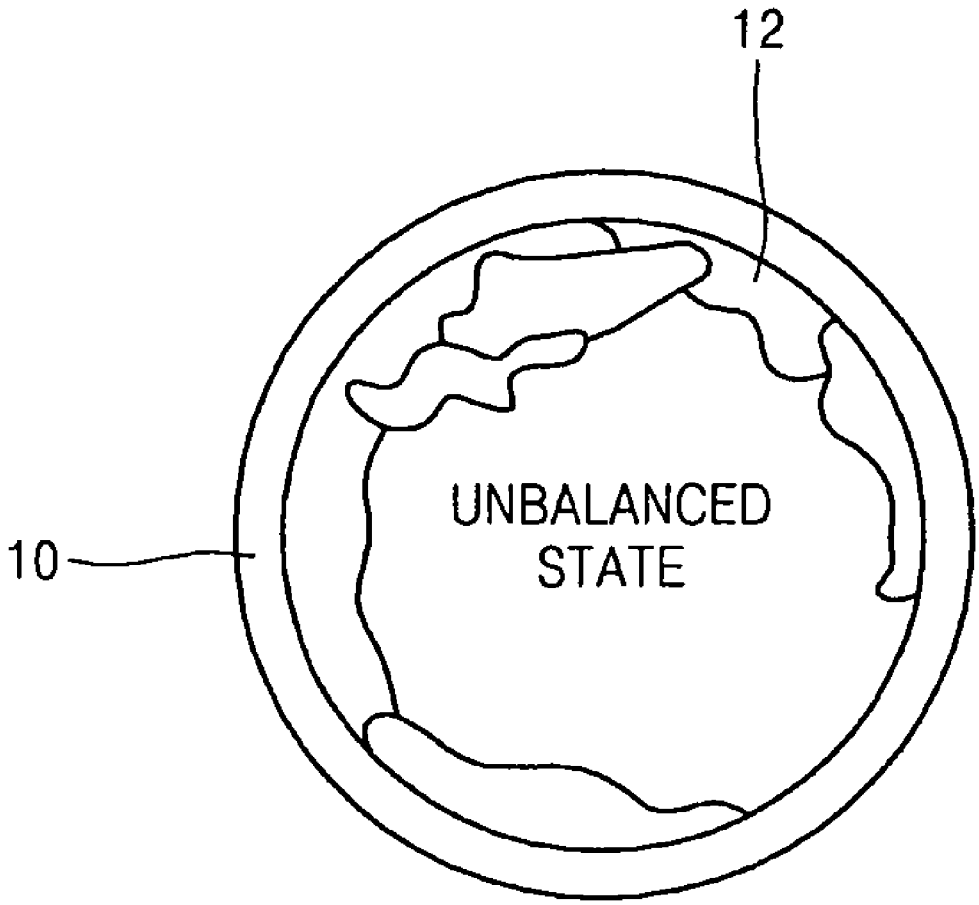
FIG. 1 is a view illustrating the unbalanced state of laundry in a drum of a washing machine.

Reference will now be made in detail to the embodiments, examples of which are illustrated in the accompanying drawings, wherein like reference numerals refer to like elements throughout. The embodiments are described below to explain the present invention by referring to the figures.

Figure 4:
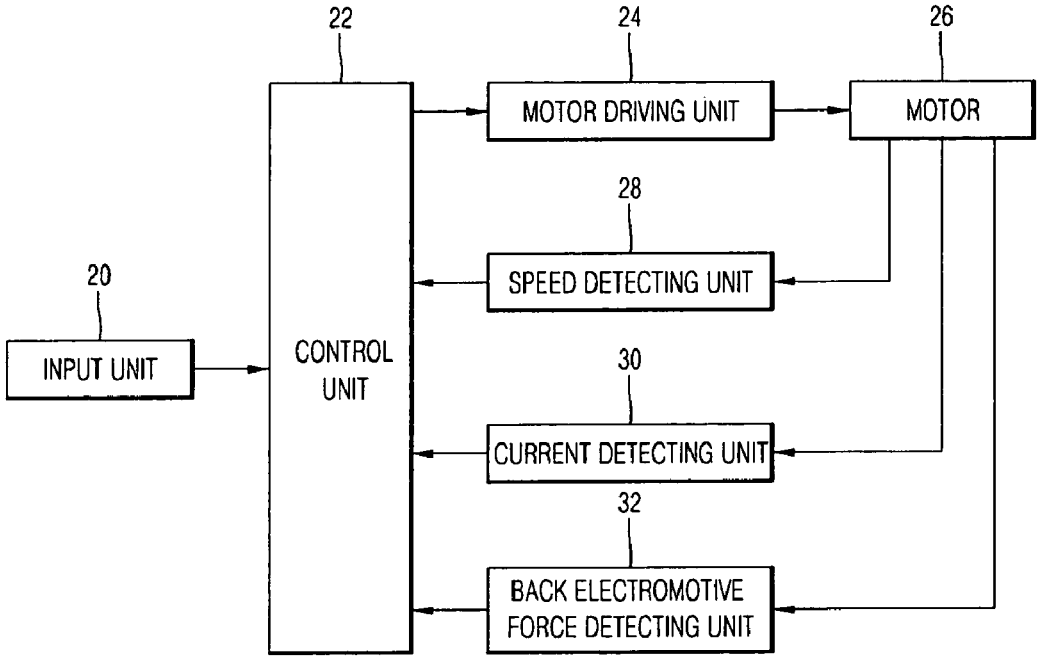
FIG. 4 is a control block diagram of a washing machine according to embodiments.

FIG. 4 is a control block diagram of a washing machine according to embodiments.

Referring to FIG. 4, the washing machine includes an input unit 20 to allow a user to input an operation command, including setting of a spin-drying operation, a control unit 22 to control the overall operation of the washing machine, such as washing, rinsing, and spin-drying, a motor driving unit 24 to drive a motor 26 that rotates a drum 10 according to the control of the control unit 22, a speed detecting unit 28 to transmit a motor speed signal corresponding to the rotation speed of the drum 10 to the control unit 22, a current detecting unit 30 to transmit a motor current signal corresponding to the rotation speed of the drum 10 to the control unit 22, and a back electromotive force detecting unit 32 to transmit a back electromotive force proportional to the rotation speed of the drum 10 to the control unit 22.

Figure 5:
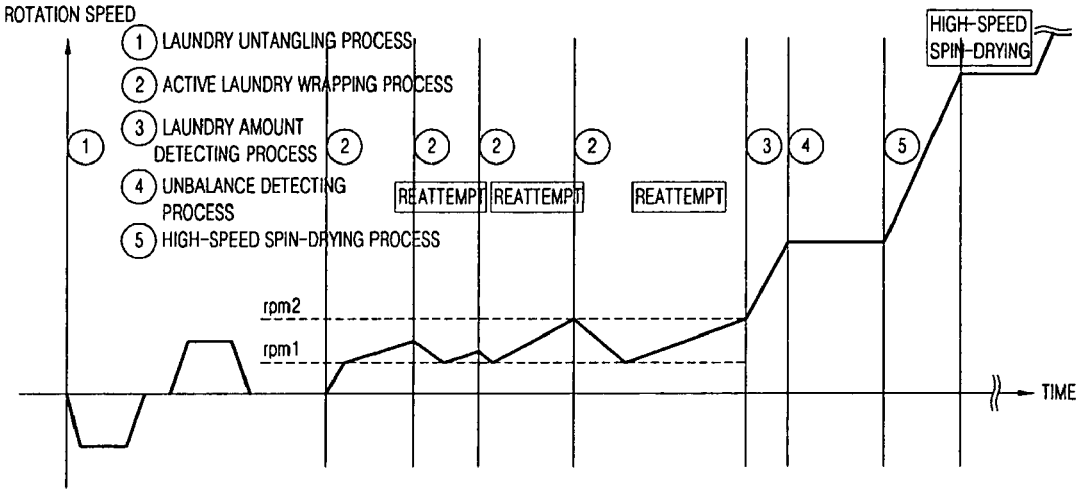
FIG. 5 is a drum speed graph illustrating an unbalance reduction control procedure of the washing machine according to the present embodiments.

The control unit 22 performs an unbalance reduction control procedure to maintain the balanced state of laundry 12, when a spin-drying operation is initiated, as in the conventional art. As shown in FIG. 5, the unbalance reduction control procedure according to the present invention includes a laundry untangling process ① to untangle the tangled laundry 12 by rotating the drum 10 in alternating directions when a spin-drying operation is initiated, an active laundry wrapping process ② to determine the unbalanced state of the laundry in real time through the detection of current at the section where the speed of the drum 10 is accelerated from a first rotation speed rpm1 to a second rotation speed rpm2, a laundry amount detecting process ③ to estimate the weight of the laundry 12 such that the weight of the laundry 12 is utilized as basic information to estimate an unbalance size using parameters, such as speed change and current ripple of the drum 10, or set an allowable unbalance size before a high-speed spin-drying operation, an unbalance detecting process ④ to estimate an unbalance size in the drum 10 using the estimated weight information and the control variable, such as the speed ripple or the current ripple, and a high-speed spin-drying process ⑤ to discharge moisture contained in the laundry 12 outside using a centrifugal force caused by rotating the drum 10 at a high speed when the estimated unbalance size is within an allowable value. These processes are sequentially performed. When the estimated unbalance size is greater than the allowable value, on the other hand, the procedure returns to the laundry untangling process ①, as in the conventional art, and then the unbalance reduction control procedure is repeated.

The unbalance reduction control procedure according to the present embodiments is characterized by determining the unbalanced state of the laundry in real time, during the laundry wrapping process to reperform only the laundry wrapping process ②.

To this end, the control unit 22 sets a third rotation speed rpm3, which is a critical speed at which the laundry 12 starts to stick to the inner wall of the drum 10 during a laundry wrapping operation in which the speed of the drum 10 is accelerated from the first rotation speed rpm1 to the second rotation speed rpm2, and detects the magnitude of motor current (considerably small as compared to the current at the rpm1 operation section), flowing the moment the rotation speed of the drum 10 exceeds the third rotation speed rpm3, through the current detecting unit 30. When the laundry 12 is unbalanced, the current ripple increases, and the average value of the current decreases, with the result that the minimum value of the current is always approximately 0. Consequently, an unbalance current limit value is set to an arbitrary value of approximately 0, and, when the detected motor current value is less than the current limit value, it is determined that the laundry 12 is in an unbalanced state. When it is determined that the laundry 12 is distributed in the drum 10 in the unbalanced state, the drum 10 is rotated at the first rotation speed rpm1 to reperform the laundry wrapping process ②.

Also, the unbalance reduction control procedure according to the present embodiment is characterized by determining the unbalanced state of the laundry in real time using duty information (a value proportional to a voltage command applied to the motor), during the laundry wrapping process, to reperform only the laundry wrapping process ②. Here, the duty means a ratio of a switch turn-on section to a switching cycle of a switch to control voltage applied to the motor 26.

To this end, the control unit 22 sets a third rotation speed rpm3, which is a critical speed at which the laundry 12 starts to stick to the inner wall of the drum 10 during a laundry wrapping operation in which the speed of the drum 10 is accelerated from the first rotation speed rpm1 to the second rotation speed rpm2, and calculates the size of a reference duty the moment the rotation speed of the drum 10 exceeds the third rotation speed rpm3 to generate an unbalance determination signal from the minimum value of the difference between the actually-applied duty and the reference duty, and compares the generated unbalance determination signal with the unbalance limit value. When it is determined that the laundry 12 is distributed in the drum 10 in the unbalanced state, the drum 10 is rotated at the first rotation speed rpm1 to reperform the laundry wrapping process ②.

The third rotation speed rpm3 is an arbitrary speed between the first rotation speed rpm1 and the second rotation speed rpm2. The third rotation speed rpm3 may be changed depending upon the diameter of the drum 10 and the amount and kind of the laundry 12.

When the laundry 12 is unbalanced, the laundry 12 is changed from the unbalanced state to the balanced state by the re-performance of laundry wrapping process ②. Consequently, the unbalance value estimated at the subsequent unbalance detecting process 4, falls within the allowable value, and therefore, the unbalance reduction control time that is necessary for the procedure to return to the laundry untangling process ①, is reduced.

Hereinafter, the operation and effects of the washing machine with the above-stated construction and a control method thereof will be described.

Figure 6:
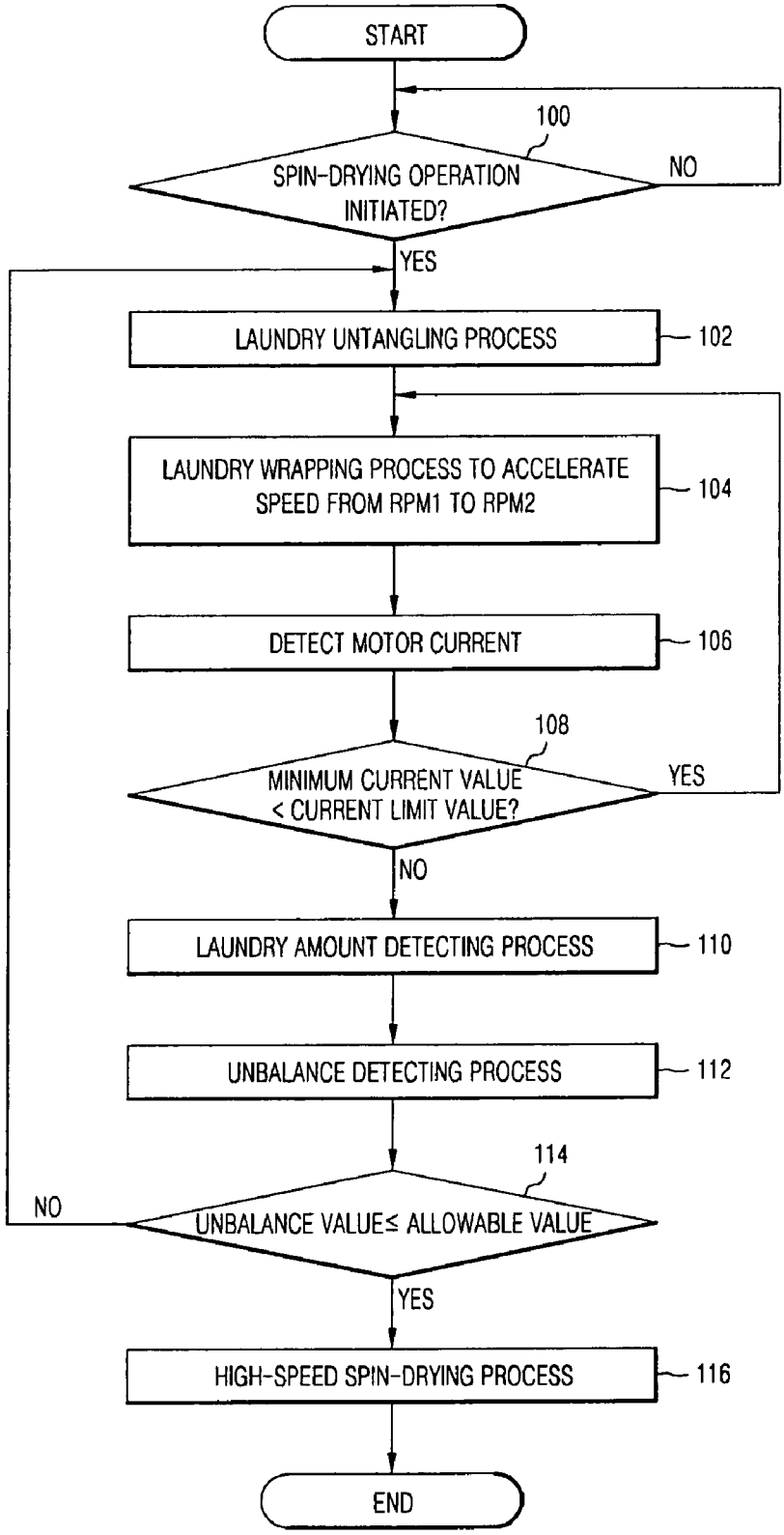
FIG. 6 is a flow chart illustrating an unbalance reduction control operation of a washing machine according to a first embodiment.

FIG. 6 is a flow chart illustrating an unbalance reduction control operation of a washing machine according to a first embodiment. In this embodiment, the unbalanced state of laundry 12 is determined in real time through the detection of current when a spin-drying operation is initiated in order to reduce an unbalance reduction control time to maintain the balanced state of the laundry 12.

Figure 7:
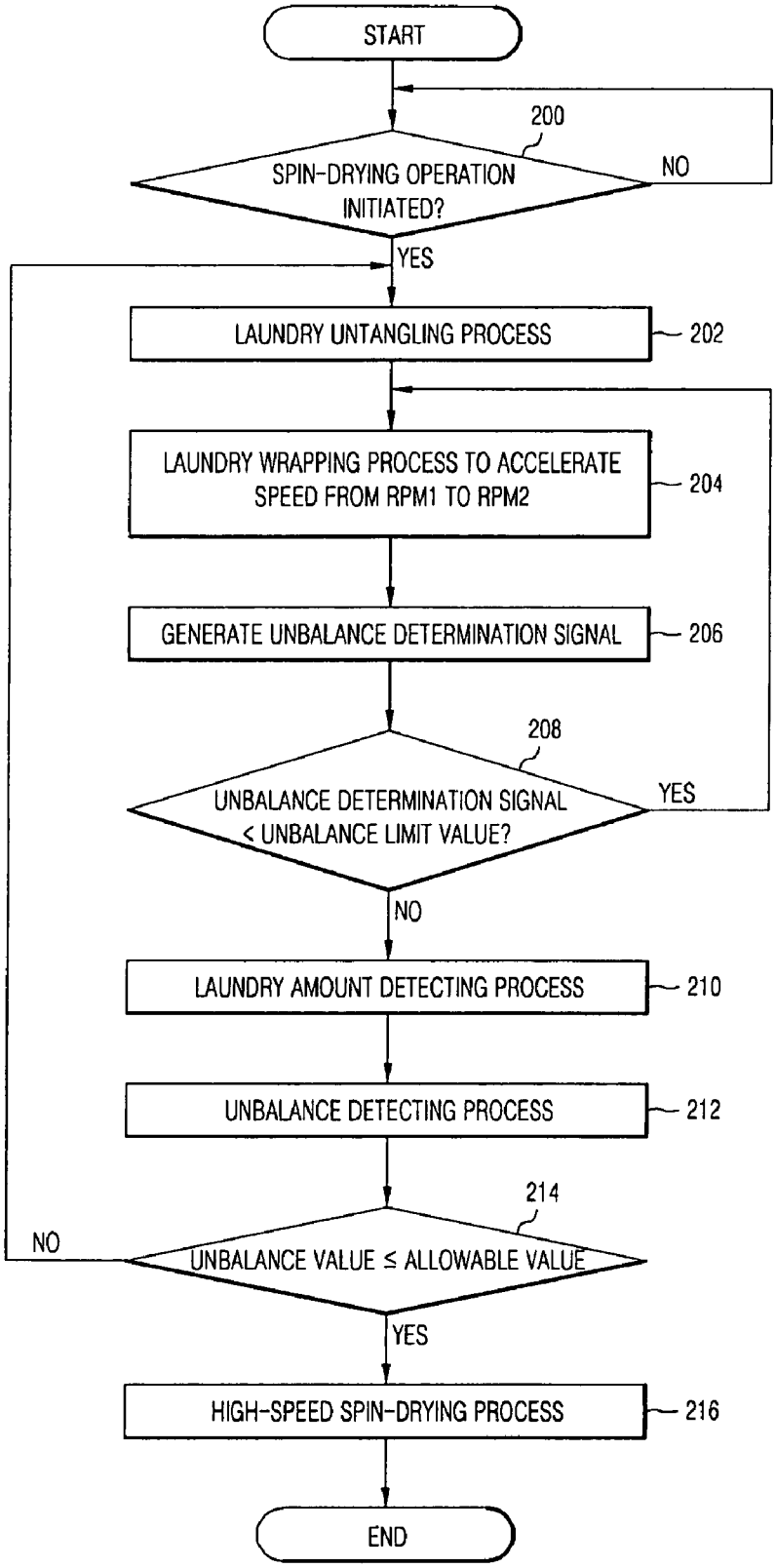
FIG. 7 is a flow chart illustrating an unbalance reduction control operation of a washing machine according to a second embodiment.

FIG. 7 is a flow chart illustrating an unbalance reduction control operation of a washing machine according to a second embodiment. In this embodiment, the washing machine does not include a current detection circuit, and the unbalanced state of laundry 12 is determined in real time using duty information (a voltage command value) when a spin-drying operation is initiated in order to reduce an unbalance reduction control time to maintain the balanced state of the laundry 12.

The following description will be given with simultaneous reference to FIGS. 6 and 7 to avoid the duplicate explanation of the same part.

When a user puts laundry 12 in the drum 10 and inputs an operation command including setting a spin-drying operation through the input unit 20, the control unit 22 sequentially performs a washing operation, a rinsing operation, and a spin-drying operation.

The control unit 22 determines whether the spin-drying operation is initiated (100) (200). When it is determined that the spin-drying operation is initiated, the control unit 22 controls the operation of the motor 26 through the motor driving unit 24 to rotate the drum 10 in alternating directions such that a laundry untangling process ① to untangle the tangled laundry 12 is performed as shown in FIG. 5 (102) (202). If the control unit determines that the spin-drying operation is not initiated, the procedure returns to operation 100, 200.

After the laundry untangling process ①, the control unit 22 performs a laundry wrapping process ② in which the speed of the drum 10 is accelerated from a first rotation speed rpm1 to a second rotation speed rpm2 as shown in FIG. 5 (104) (204). The first rotation speed rpm 1 is a speed of the drum 10 at which the laundry 12 does not stick to the inner wall of the drum 10, and the second rotation speed rpm2 is a speed of the drum 10 at which the laundry 12 sticks to the inner wall of the drum 10. Between the first rotation speed rpm1 and the second rotation speed rpm2 is set a third rotation speed rpm3, which is a critical speed at which the laundry 12 starts to stick to the inner wall of the drum 10.

When laundry wrapping process ② is initiated, the control unit 22 calculates a duty change range (voltage applied to the motor) proportional to the magnitude of a current ripple, while changing the acceleration (rpm/sec) from the first rotation speed rpm1 to the second rotation speed rpm2 depending upon the diameter of the drum 10 and the amount and kind of the laundry 12 to generate an unbalance determination signal as follows.

Generally, the equation of motion of a rotary body (specifically, a drum) is as follows.

$$Te=TL+B\cdot w+J\cdot(dw/dt) \quad \text{[Equation 1]},$$

where, $T_e$ is electric torque, $T_L$ is load torque, B is the coefficient of friction, w is rotational angular velocity, J is the coefficient of inertia, and t is time.

Figure 8:
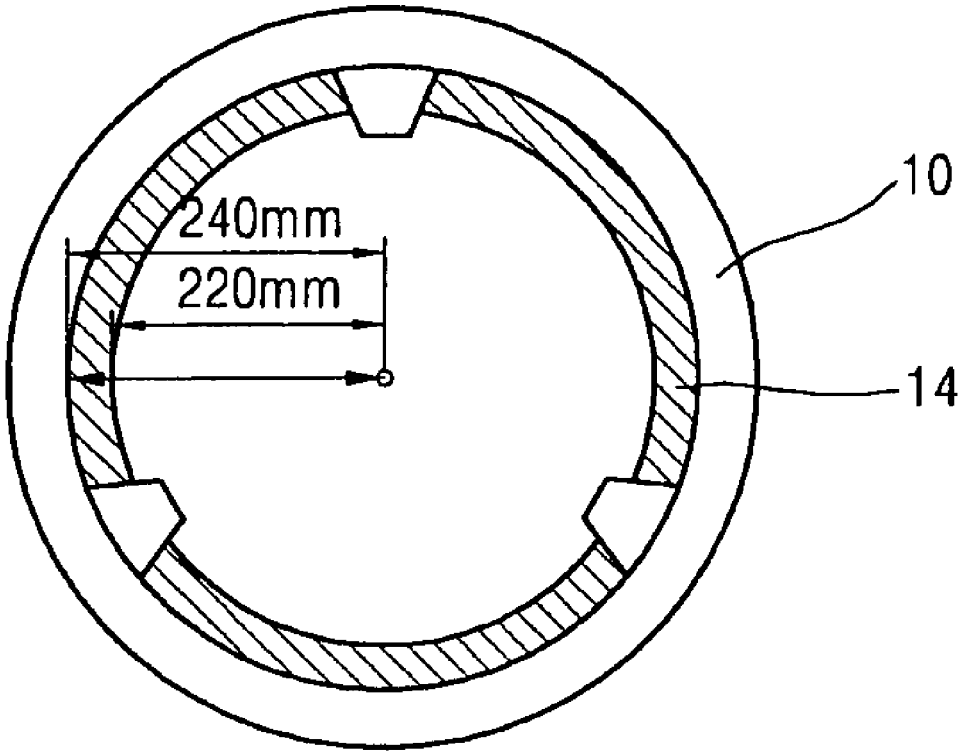
FIG. 8 is a view illustrating only a uniform load existing in a drum.

FIG. 8 is a view illustrating only a uniform load existing in the drum. A rubber load 14, as the uniform load, is mounted to the inner wall of the drum 10.

Figure 9:
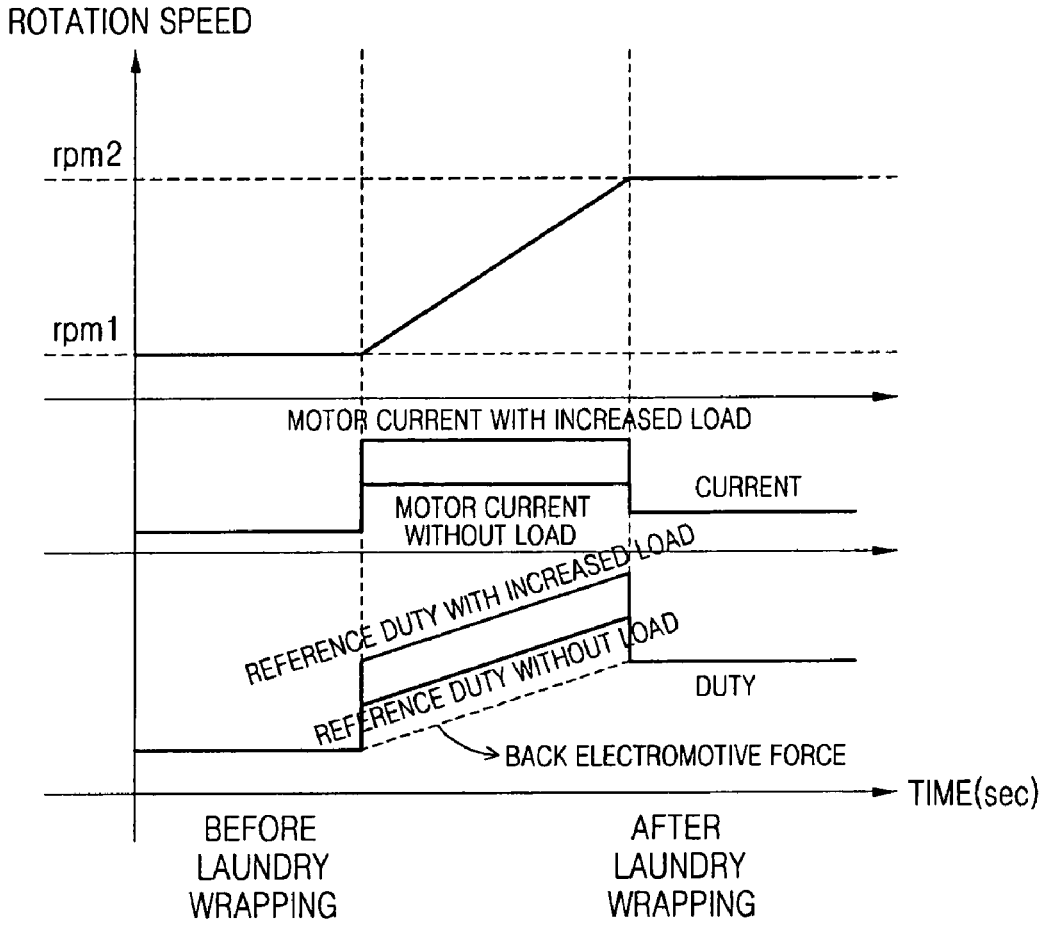
FIG. 9 is a view illustrating motor current and duty traces during a laundry wrapping operation in the uniform load condition of FIG. 8.

FIG. 9 is a view illustrating motor current and duty traces during a laundry wrapping operation in the uniform load condition of FIG. 8.

Referring to FIGS. 8 and 9, when the speed of the drum 10 is the first rotation speed rpm1 or the second rotation speed rpm2, there is neither acceleration nor load torque $T_L$, and therefore, only the current component of the torque term B w by the coefficient of friction B exists. At the section where the speed of the drum 10 is accelerated from a first rotation speed rpm1 to a second rotation speed rpm2, the acceleration exists, and therefore, current increased by the magnitude proportional to the product J·(dw/dt) of the inertia J of the load and the acceleration dw/dt flows. Consequently, when the load increases in the same condition, larger current flows during the acceleration. A back electromotive force (emf) is a voltage generated at an input terminal of the motor 26 during the rotation of the motor 26. Generally, the back electromotive force (emf) is proportional to the rotation speed of the motor 26. Consequently, the back electromotive force (emf) of the motor 26 is represented by Equation 2 below.

$$\text{Back electromotive force(emf)}=k\times\text{motor speed (rpm)}+b \quad \text{[Equation 2]},$$

where, k and b are constants.

A voltage equation of the motor 26 may be derived from Equation 2, as represented by Equation 3 below.

$$\text{Duty}(V)=emf+R\cdot I+L\cdot(di/dt) \quad \text{[Equation 3]},$$

where, duty is applied voltage, R is winding resistance, I is current of the motor, and L is inductance of the motor.

During the accelerated operation of the drum 10, (di/dt)≈0, and the current of the motor 26 is a voltage dropping component proportional to the magnitude of the load. Consequently, Equation 3 may be changed to Equation 4.

$$\text{Duty}=\text{back electromotive force(emf)}+C\cdot\text{load} \quad \text{[Equation 4]}$$

Where, C is a constant.

On the assumption that a load of the drum 10 without the laundry 12 is L0, and a load of the laundry 12 is L, the total load is represented as follows: load=L0+L.

A duty applied with no load may be represented by Equation 5 below.

$$\text{Duty(no load)}=\text{back electromotive force}+C\cdot L0=\text{back electromotive force}+C0 \quad \text{[Equation 5]}$$

A duty applied with an arbitrary load may be represented by Equation 6 below.

$$\text{Duty(arbitrary load)}=\text{back electromotive force}+C\cdot(L0+L)=\text{back electromotive force}+C0+C1=\text{duty (no load)}+C1 \quad \text{[Equation 6]}$$

Consequently, when C1, a constant, is added to the no load duty, it is possible to estimate the duty with the arbitrary load, duty (arbitrary load).

Figure 10:
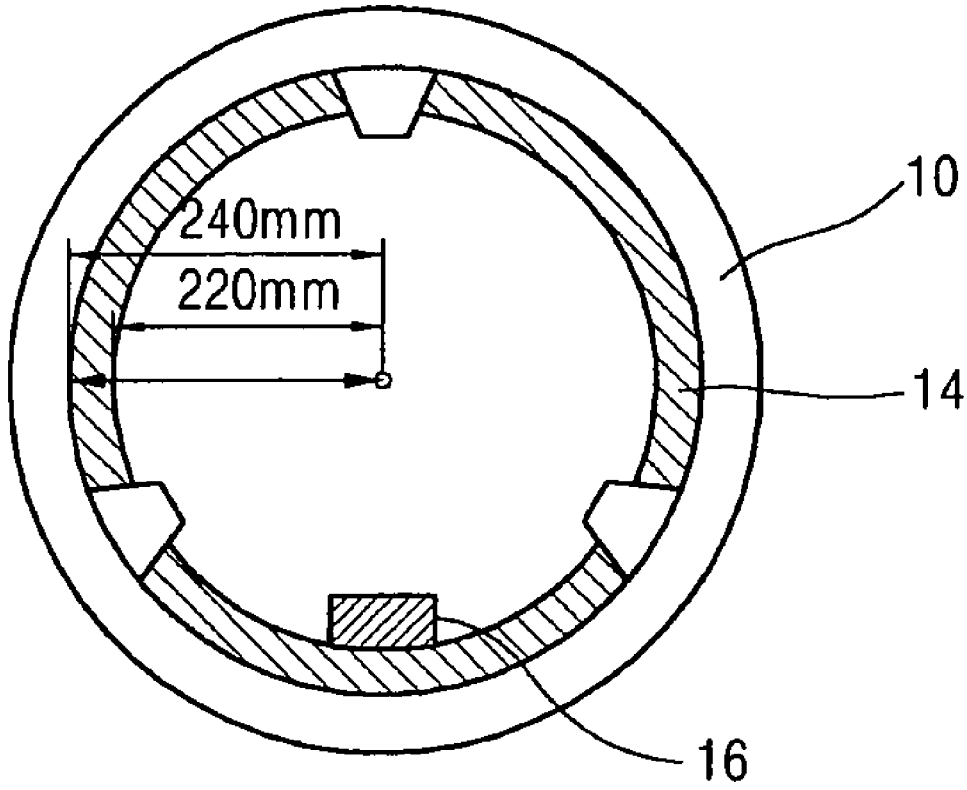
FIG. 10 is a view illustrating an unbalance existing in a drum together with a uniform load.

FIG. 10 is a view illustrating an unbalance existing in the drum together with a uniform load. A rubber load 14 is mounted to the inner wall of the drum 10, and a rubber unbalance 16 of 400 g, for example, is mounted to one side of the inner wall of the drum 10.

Figure 11:
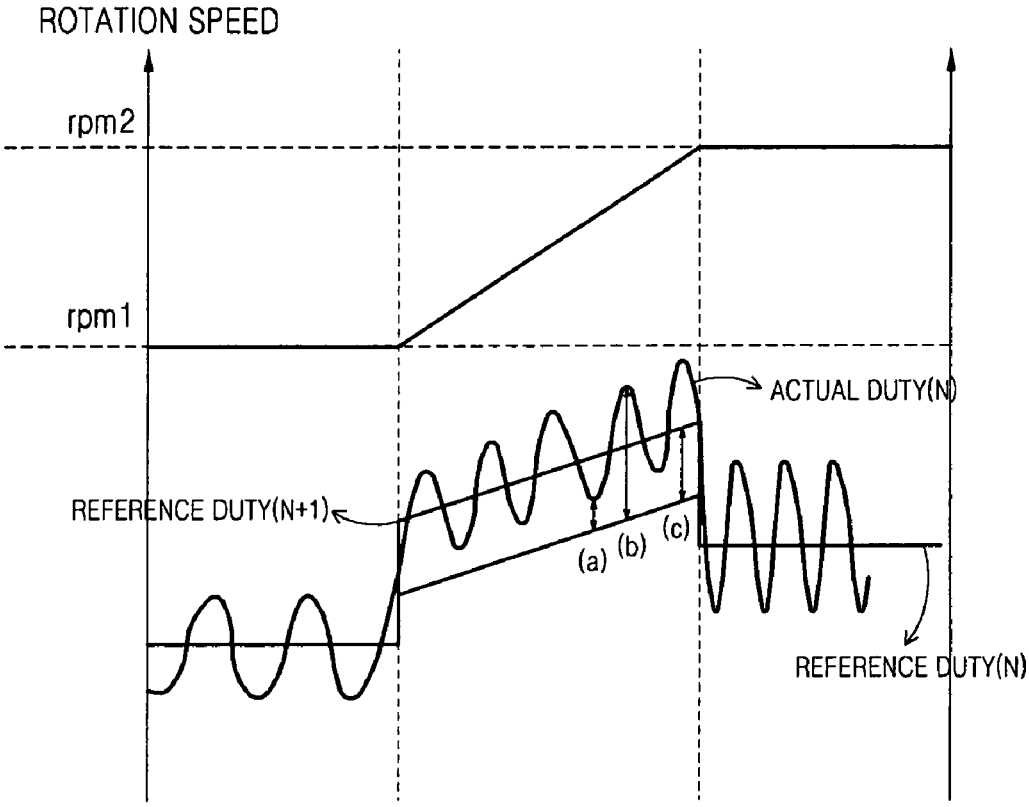
FIG. 11 is a view illustrating a duty waveform during a laundry wrapping operation with the load and unbalance of FIG. 10.

FIG. 11 is a view illustrating a duty waveform during a laundry wrapping operation with the load and unbalance of FIG. 10.

FIG. 11 illustrates a method of estimating C1 from an arbitrary load. N indicates the number of laundry wrapping attempts.

The actual duty (N) shows a duty trace of an arbitrary load having both the load 14 and the unbalance 16 as shown in FIG. 10 at an $N^{th}$ laundry wrapping attempt. The speed ripple is caused by the unbalance, and the duty trace appears in the reverse form of the speed ripple to control the speed ripple.

Next reference duty (N+1)=current reference duty (N)+c

Where, a is minimum value [actual duty (N)−reference duty (N)], b is maximum value [actual duty (N)−reference duty (N)], and c is (a+b)/2.

The duty trace with no load, i.e., the 'duty (no load)' may be acquired experimentally, and therefore, when N=0 in FIG. 10, the duty trace with no load is used as an initial value of the reference duty, i.e., a reference duty (0).

However, the torque and current characteristics when the laundry 12 is actually put in the drum 10 are different.

Figure 12:
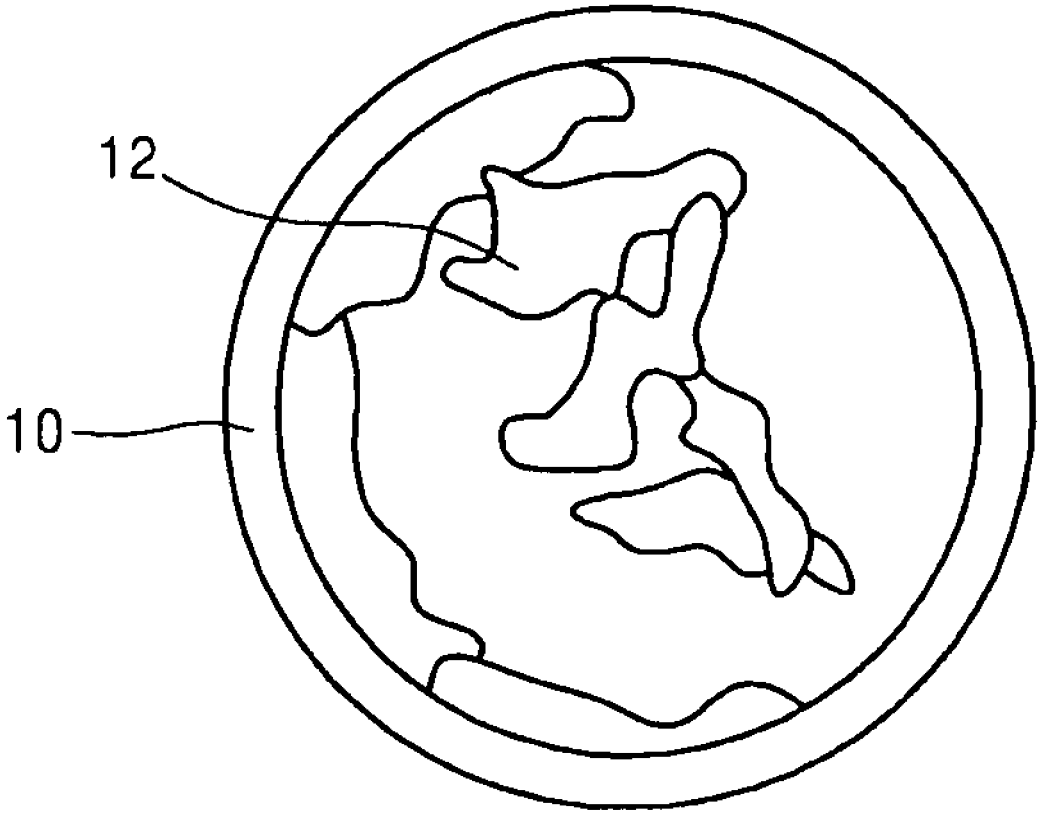
FIG. 12 is a view illustrating a drum of a washing machine before laundry is wound in the drum.

For the laundry 12, there exists a torque ripple due to the falling motion of the laundry 12, as shown in FIG. 12, before the laundry wrapping process is completed. Also, the laundry 12 is changed to the unbalanced state shown in FIG. 1 or the balanced state shown FIG. 2, after the laundry wrapping process is completed.

Figure 13:
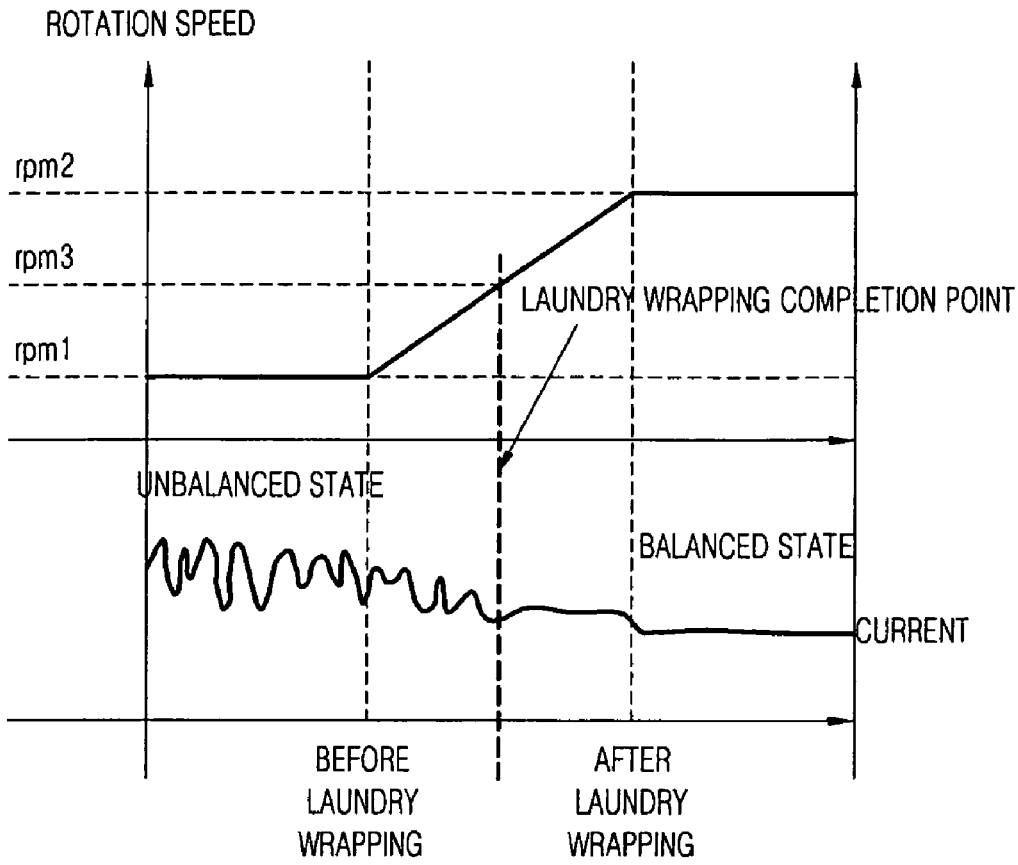
FIG. 13 is a view illustrating a speed-current waveform when the balance is maintained by the laundry wrapping process of FIG. 6.

FIG. 13 is a view illustrating a speed-current waveform when the balance is maintained by the laundry wrapping process at operation 104 of FIG. 6.

Referring to FIG. 13, the third rotation speed rpm3, which is between the first rotation speed rpm1 and the second rotation speed rpm2, is a critical speed at which the laundry 12 starts to stick to the inner wall of the drum 10. Generally, the laundry wrapping process is completed at the third rotation speed rpm3.

At the section where the speed of the drum 10 is the first rotation speed rpm 1, a load torque $T_L$ increases due to the falling motion of the laundry 12, with the result that larger current flows on average.

At the section where the speed of the drum 10 is accelerated from the first rotation speed rpm1 to the second rotation speed rpm2, all the laundry 12 is brought into tight contact with the inner wall of the drum 10 the moment the speed of the drum 10 exceeds the third rotation speed rpm3. Consequently, the laundry 12 is changed to the torque term J·(dw/dt) by the inertia, not the load torque. When the acceleration from the first rotation speed rpm1 to the second rotation speed rpm2 is small, (dw/dt) converges to zero, and therefore, the torque current component by the acceleration approaches zero. Consequently, after the speed of the drum 10 exceeds the third rotation speed rpm3, the magnitude of the motor current to drive the drum 10 is much less than the current at the section where the drum is rotated at the first rotation speed rpm1.

Figure 14:
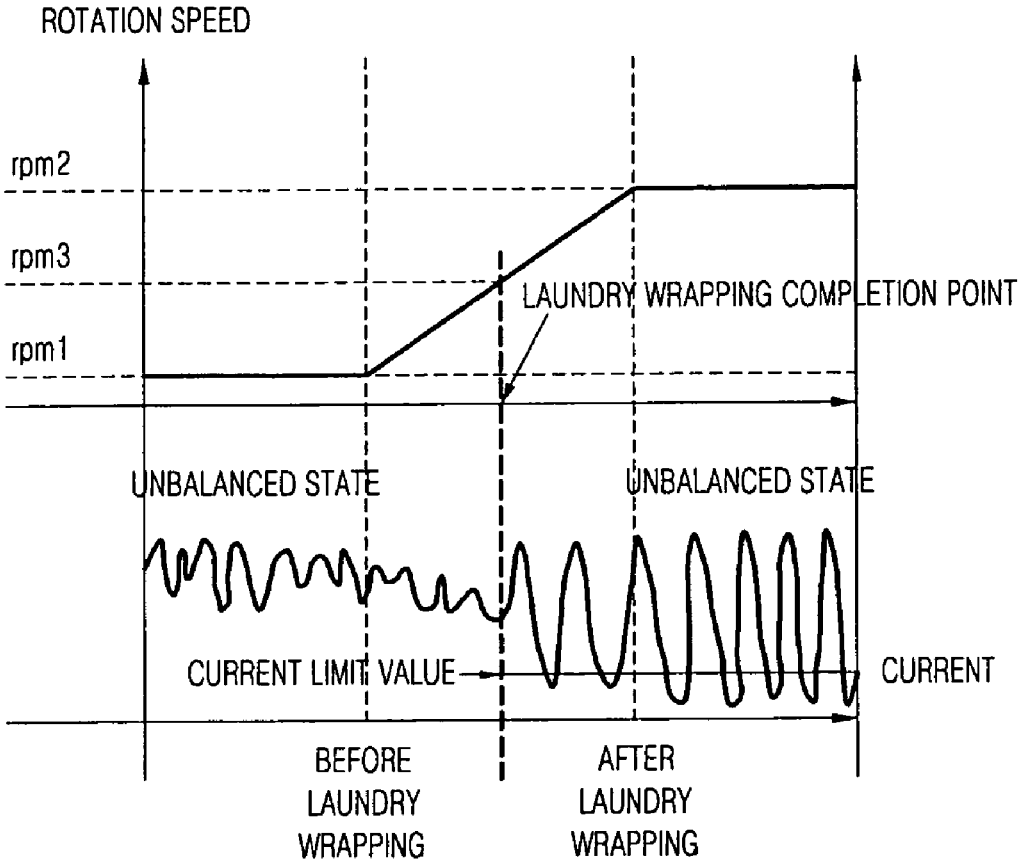
FIG. 14 is a view illustrating a speed-current waveform when the balance is not maintained by the laundry wrapping process of FIG. 6.

FIG. 14 is a view illustrating a speed-current waveform when the balance is not maintained by the laundry wrapping process ② at operation 104 of FIG. 6.

Referring to FIG. 14, a load torque $T_L$ increases due to the falling motion of the laundry 12 at the section where the speed of the drum 10 is the first rotation speed rpm1, with the result that larger current flows on average.

Figure 2:
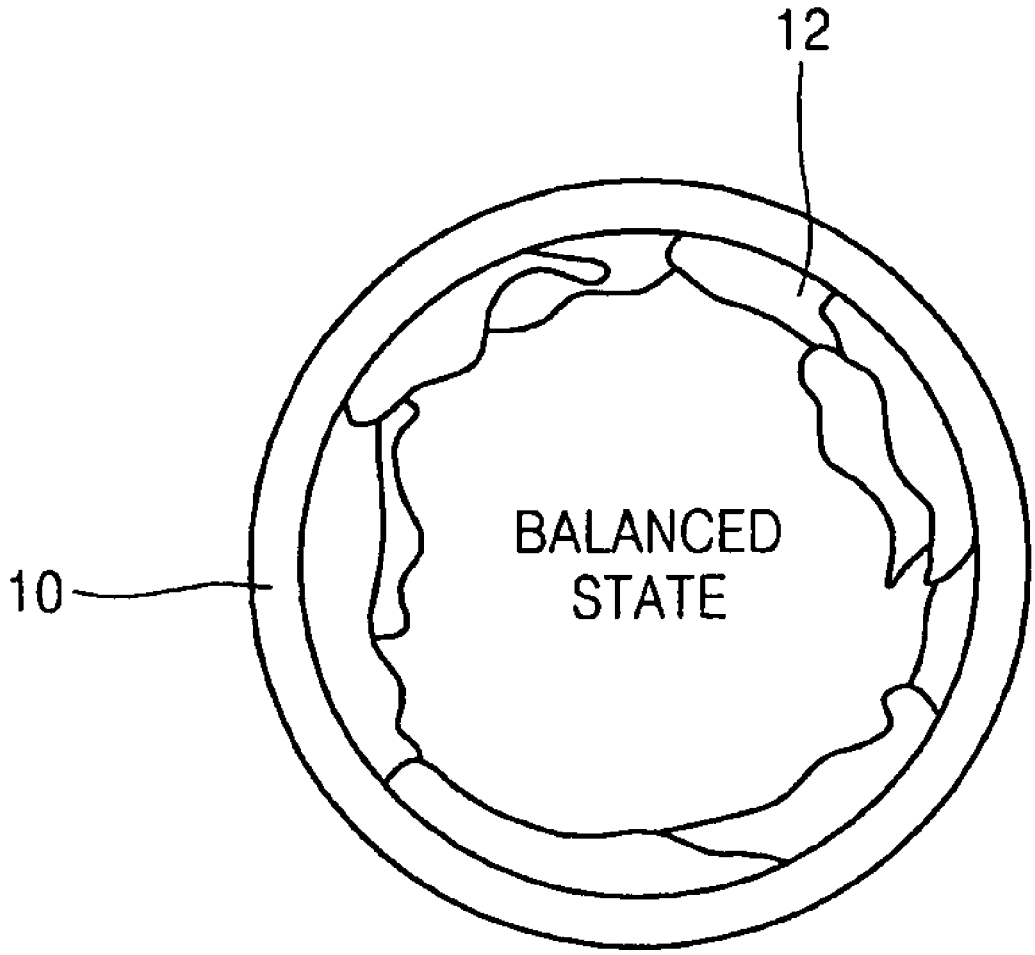
FIG. 2 is a view illustrating the balanced state of laundry in a drum of a washing machine.
Figure 3:
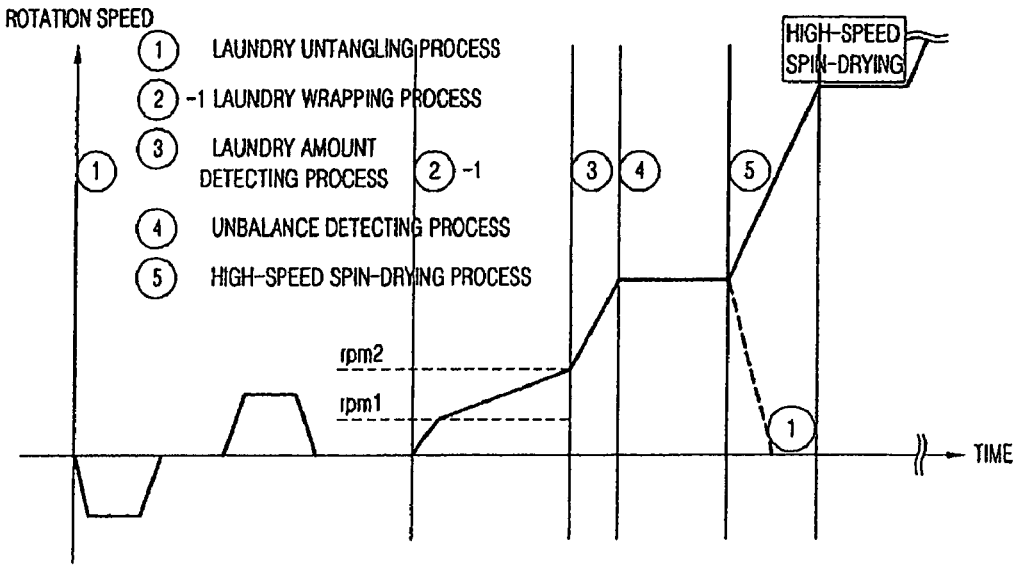
FIG. 3 is a drum speed graph illustrating an unbalance reduction control procedure of a conventional washing machine.

At the section where the speed of the drum 10 is accelerated from the first rotation speed rpm1 to the second rotation speed rpm2, a speed ripple exists during one rotation of the drum 10 when the laundry 12 is distributed in the unbalanced state, as shown in FIG. 1, after the speed of the drum 10 exceeds the third rotation speed rpm3. Since the control unit 22 increases current when the speed decreases, and decreases current when the speed increases, the speed ripple due to the unbalance induces a current ripple. At this time, the magnitude of the current ripple is proportional to the size of the unbalance.

The average current at the section where the speed of the drum 10 is greater than the third rotation speed rpm3 is small, as in when the load is in the balanced state. However, the current ripple is very large. As a result, the minimum current value at the operation at which the speed of the drum 10 is between the third rotation speed rpm3 and the second rotation speed rpm2 is approximately zero.

Consequently, the control unit 22 detects the magnitude of the motor current through the current detecting unit 30 during the laundry wrapping process in which the speed of the drum 10 is accelerated from the first rotation speed rpm1 to the second rotation speed rpm2 (106 of FIG. 6). When the unbalance exists, the current ripple increases and the average current value decreases, with the result that the minimum current value is always approximately zero.

Subsequently, the control unit 22 determines whether the minimum value of the detected motor current is less than a predetermined current limit value (108). When it is determined that the minimum value of the motor current is less than the current limit value, the control unit 22 determines that the laundry is in the unbalanced state, and the procedure returns to operation 104 to reperform the laundry wrapping process ② in which the drum 10 is rotated at the first rotation speed rpm1 as shown in FIG. 5.

When it is determined at operation 108 that the minimum value of the motor current is not less than the current limit value, the control unit 22 determines that the laundry is in the balanced state, and performs the laundry amount detecting process ③ to estimate the weight of the laundry 12 such that the weight of the laundry 12 is utilized as basic information to estimate an unbalance size using parameters, such as speed change and current ripple of the drum 10, or set an allowable unbalance size before a high-speed spin-drying operation, as shown in FIG. 5.

Figure 15:
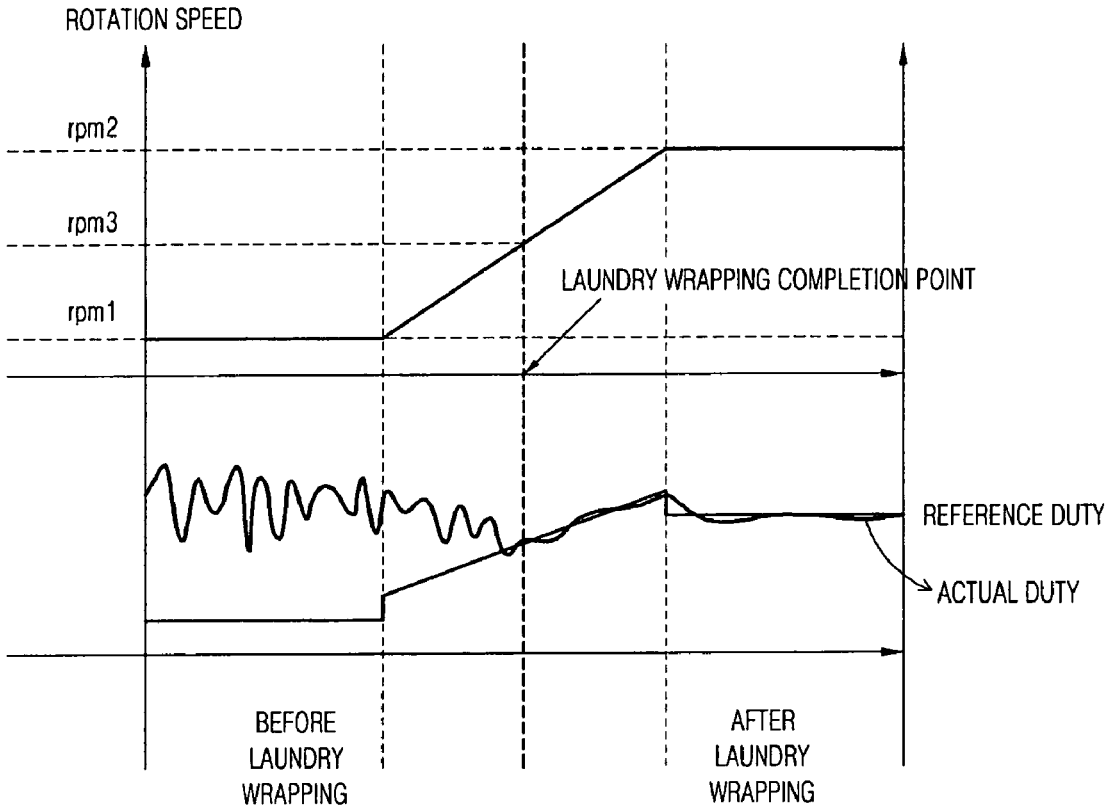
FIG. 15 is a view illustrating a duty waveform when the balance is maintained by the laundry wrapping process of FIG. 7.
Figure 16:
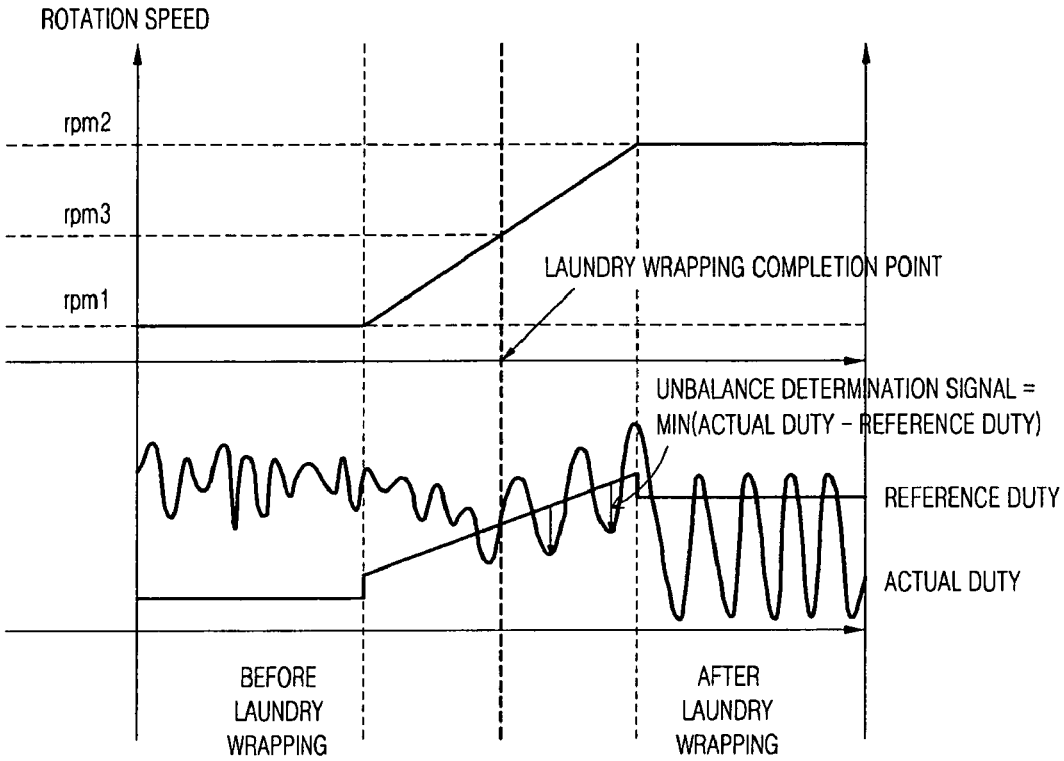
FIG. 16 is a view illustrating a duty waveform when the balance is not maintained by the laundry wrapping process of FIG. 7.

FIG. 15 is a view illustrating a duty waveform when the balance is maintained by the laundry wrapping process ② at operation 204 of FIG. 7, and FIG. 16 is a view illustrating a duty waveform when the balance is not maintained by the laundry wrapping process ② at operation 204 of FIG. 7.

Referring to FIGS. 15 and 16, the third rotation speed rpm3, which is between the first rotation speed rpm1 and the second rotation speed rpm2, is a critical speed at which the laundry 12 starts to stick to the inner wall of the drum 10. Generally, the laundry wrapping process is completed at the third rotation speed rpm3.

When the laundry 12 is a load, the falling motion of the laundry exists at an operation section where the speed of the drum 10 is less than the third rotational speed rpm3. As a result, the average load torque and the torque change are very large as compared to when only the uniform load exists. Consequently, the duty waveform is larger than that of the reference duty, as shown at the section before the laundry wrapping process of FIG. 15, and the change of the duty waveform is excessive.

When the speed of the drum 10 exceeds the third rotation speed rpm3, the laundry 12 sticks to the inner wall of the drum 10, with the result that all the laundry 12 becomes an inertia load, and therefore, the average duty coincides with the reference duty. When the laundry 12 is distributed uniformly, little ripple component exists in the duty, as at the section before the laundry wrapping process of FIG. 15. When the laundry 12 is distributed nonuniformly, on the other hand, a duty ripple having the same cycle as the rotational frequency of the drum 10 exists, as at the section after the laundry wrapping process of FIG. 16.

Consequently, Equation 7 may be derived from the addition of the unbalanced component to Equation 3.

$$\text{Duty}=\text{emf}+R\cdot(I_{LOAD}+I_{Unb}\sin wt) \quad \text{[Equation 7]},$$

where, $I_{LOAD}$ is the magnitude of the current ripple due to the uniform load, and $I_{Unb}$ is the magnitude of the current ripple due to the unbalance. The magnitude of the current ripple due to the unbalance is proportional to the unbalance amount.

Rearranging Equation 7, $$\text{Duty}=\text{emf}+R\cdot I_{LOAD}+R\cdot I_{Unb}\cdot\sin wt=\text{reference duty}(N)+R\cdot I_{Unb}\cdot\sin wt$$

$$R\cdot I_{Unb}\cdot\sin wt=\text{duty}-\text{reference duty}(N) \quad \text{[Equation 8]}$$

Accordingly, Min[duty−reference duty(N)]=−R·$I_{Unb}$, where, R is a constant of the motor.

$I_{Unb}$ is proportional to the unbalance, and therefore, the minimum value (actual duty−reference duty) indicates the unbalance size.

Accordingly, an unbalance determination signal may be represented by Equation 9 below.

$$\text{Unbalance determination signal}=\text{Min}[\text{actual duty (rpm)}-\text{reference duty(rpm)}] \quad \text{[Equation 9]}$$

Through the above-described operation, the control unit 22 generates an unbalance determination signal during the laundry wrapping process in which the speed of the drum 10 is accelerated from the first rotation speed rpm1 to the second rotation speed rpm2 (206 of FIG. 7), and determines whether the generated unbalance determination signal value is less than a predetermined unbalance limit value (208).

When it is determined at operation 208 that the unbalance determination signal value is less than the predetermined unbalance limit value, the control unit 22 determines that the laundry is in the unbalanced state, and the procedure returns to operation 204 to reperform the laundry wrapping process ② in which the drum 10 is rotated at the first rotation speed rpm1 as shown in FIG. 5.

Figure 17:
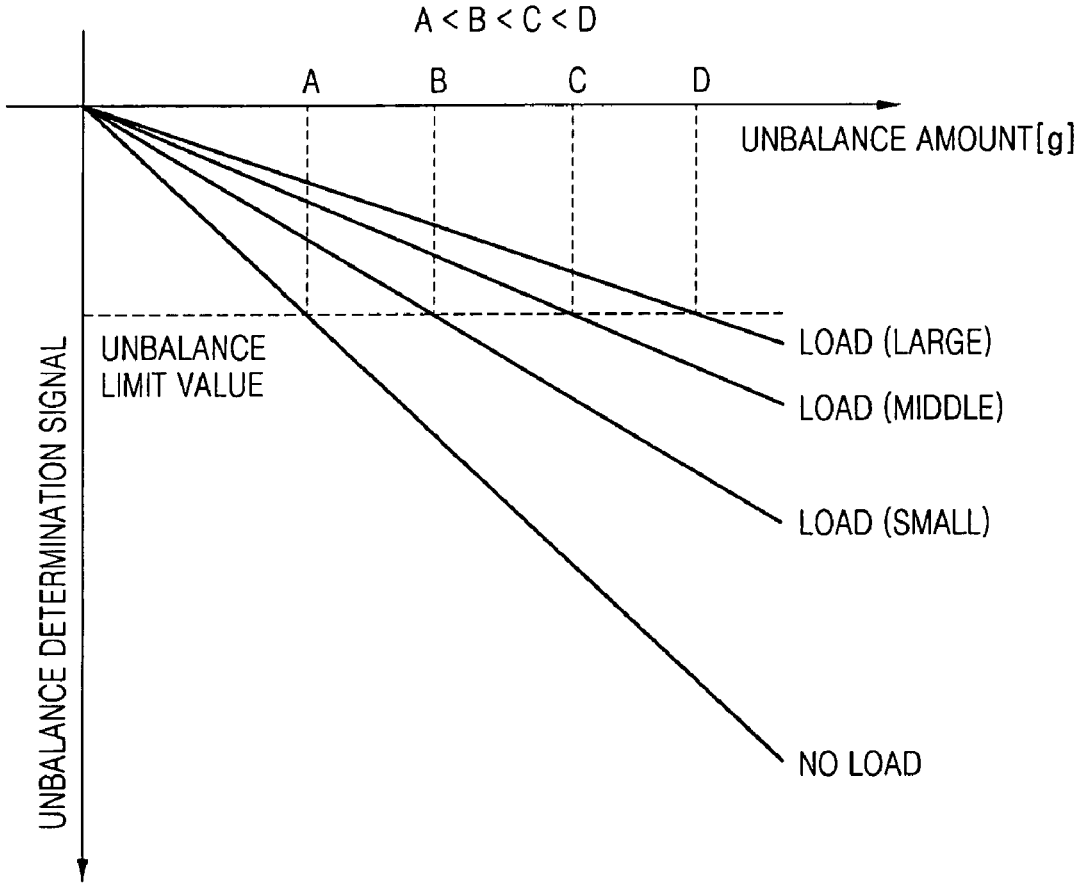
FIG. 17 is a view illustrating the trace of an unbalance determination signal when the load and the unbalance are changed.

FIG. 17 is a view illustrating the trace of an unbalance determination signal when the load and the unbalance are changed.

It is not possible to confirm the size of a load during the laundry wrapping process ②, and therefore, it is not possible to accurately limit the unbalance to a desired size. However, when the unbalance determination signal value is limited to an unbalance limit value equivalent to the unbalance level to be limited based on no load, as shown in FIG. 17, it is possible to limit the unbalance to a larger size in proportion to the load.

For example, when the unbalance limit value is set such that the unbalance is limited to 200 g at the no load condition, the unbalance is limited to 250 g for a small-amount load, the unbalance is limited to 350 g for a middle-amount load, and the unbalance is limited to 450 g for a large-amount load.

When it is determined at operation 208 that the unbalance determination signal value is not less than the unbalance limit value, the control unit 22 determines that the laundry is in the balanced state, and performs the laundry amount detecting process ③ to estimate the weight of the laundry 12 such that the weight of the laundry 12 is utilized as basic information to estimate an unbalance size using parameters, such as speed change and current ripple of the drum 10, or sets an allowable unbalance size before a high-speed spin-drying operation, as shown in FIG. 5 (210).

After the laundry amount detecting process ③ at operation 110, 210, the control unit 22 performs the unbalance detecting process ④ to estimate an unbalance size in the drum 10 using the estimated weight information and a control variable, such as a speed ripple or a current ripple, as shown in FIG. 5 (112) (212).

Subsequently, the control unit 22 determines whether the unbalance value estimated at the unbalance detecting process ④ is within an allowable value (114) (214). When it is determined that the estimated unbalance value is less than or equal to the allowable value, the control unit 22 performs the high-speed spin-drying process ⑤ to discharge moisture contained in the laundry 12 outside using a centrifugal force caused by rotating the drum 10 at a high speed, as shown in FIG. 5 (116) (216).

When it is determined at operation 114, 214 that the estimated unbalance value is greater than the allowable value, the procedure returns to the laundry untangling process ①, as in the conventional art, and then the unbalance reduction control procedure is repeated.

In the unbalance reduction control procedure according to the present embodiment, however, the balanced state of the laundry 12 is maintained during the laundry wrapping process ②, with the result that the unbalance value estimated at the unbalance detecting process ④ is within the allowable value, and therefore, the procedure does not return to the laundry untangling process ①.

Figure 18:
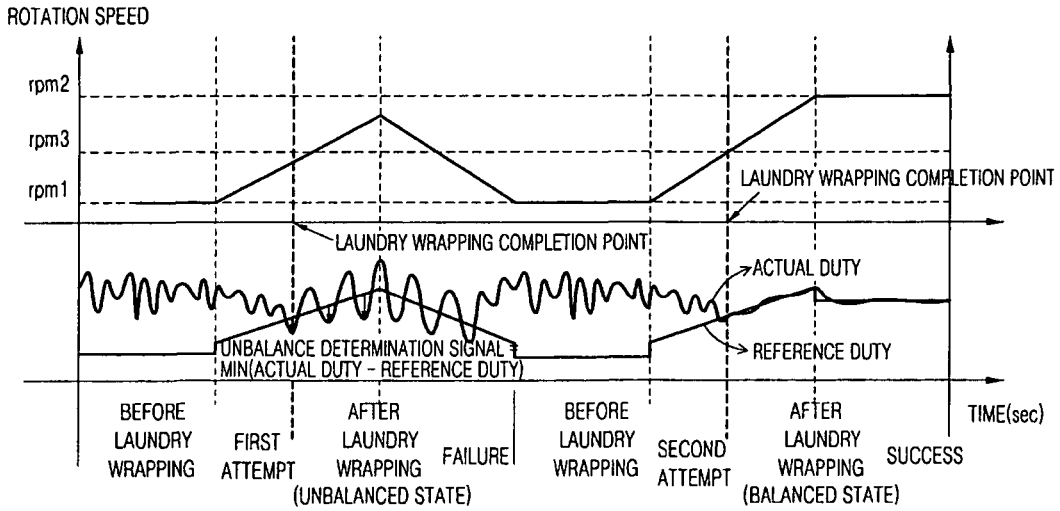
FIG. 18 is a view illustrating an application example of a laundry wrapping process of a washing machine according to the second embodiment.

FIG. 18 is a view illustrating an application example of a laundry wrapping process of a washing machine according to a second embodiment. Specifically, this drawing shows waveforms of the speed of the drum 10, the actual duty, and the reference duty when the balanced state of the laundry is maintained after the laundry wrapping process is reperformed once.

As apparent from the above description, the washing machine according to the present embodiments and the control method thereof provide the following effects. It is possible to reduce the unbalance reduction control time to maintain the balanced state of the laundry through the improved laundry wrapping operation, thereby reducing a total spin-drying time. Also, it is possible to determine the unbalanced state of the laundry in real time, during the laundry wrapping process, and, when the laundry is unbalanced, to reperform only the laundry wrapping process, thereby greatly improving the laundry wrapping success rate and thus greatly reducing the total unbalance reduction control time.

Furthermore, it is possible to determine the unbalanced state of the laundry using duty information (voltage command value) obtained from the difference between the actual duty and the reference duty. Consequently, the present embodiments are applicable to a motor controller having no current detection circuit.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A control method of a washing machine including a drum to receive laundry and a motor to rotate the drum to reduce unbalance generated due to the nonuniform distribution of the laundry, comprising:

determining whether a spin-drying operation is initiated:

when it is determined that the spin-drying operation is initiated, rotating the drum in alternating directions such that the laundry untangling process to untangle the tangled laundry;

after the laundry untangling process, wrapping the laundry by accelerating the speed of the drum by stages such that the laundry sticks to an inner wall of the drum;

detecting motor current during the wrapping of the laundry;

determining whether the laundry is in an unbalanced state or a balanced state based on the detected motor current; and controlling speed of the drum based on the result of the determination, wherein the controlling the speed of the drum includes reperforming only the laundry wrapping operation when it is determined that the laundry is in the unbalanced state.

2. The control method according to claim 1, wherein the wrapping the laundry includes accelerating the speed of the drum by stages to reduce the unbalance of the laundry before a high-speed spin-drying operation.

3. The control method according to claim 1, wherein the accelerating the speed of the drum includes accelerating the speed of the drum by stages, and controlling the speed of the drum accelerated by stages based on the detected motor current.

4. The control method according to claim 3, wherein the speed of the drum includes a first rotation speed at which the laundry does not stick to the inner wall of the drum, a second rotation speed at which the laundry sticks to the inner wall of the drum, the second rotation speed being higher than the first rotation speed, and a third rotation speed at which the laundry starts to stick to the inner wall of the drum, the third rotation speed being between the first rotation speed and the second rotation speed.

5. The control method according to claim 4, wherein the detecting the motor current includes detecting a magnitude of the motor current when the speed of the drum exceeds the third rotation speed at an operation at which the speed of the drum is accelerated from the first rotation speed to the second rotation speed.

6. The control method according to claim 4, wherein the controlling the speed of the drum includes reperforming the laundry wrapping operation by accelerating the speed of the drum from the first rotation speed, when it is determined that the laundry is in the unbalanced state.

7. The control method according to claim 4, wherein the controlling the speed of the drum includes performing a high-speed spin-drying operation by continuously accelerating the speed of the drum, when it is determined that the laundry is in the balanced state.

8. The control method according to claim 1, wherein the determining whether the laundry is in the unbalanced state or the balanced state includes searching for a minimum value of the detected motor current to compare the minimum value of the motor current to a predetermined current limit value, and determining that the laundry is in the unbalanced state when the minimum value of the motor current is less than the predetermined current limit value.

9. The control method according to claim 8, wherein the minimum value of the motor current is a minimum current value at an operation at which the speed of the drum is accelerated from the third rotation speed to the second rotation speed.

10. A control method of a washing machine including a drum to receive laundry and a motor to rotate the drum to reduce unbalance generated due to the nonuniform distribution of the laundry, comprising:

determining whether a spin-drying operation is initiated;

when it is determined that the spin-drying operation is initiated, rotating the drum in alternating directions such that the laundry untangling process to untangle the tangled laundry;

after the laundry untangling process, wrapping the laundry by accelerating the speed of the drum by stages such that the laundry sticks to an inner wall of the drum;

determining an unbalanced state of the laundry using duty information applied to the motor during the wrapping of the laundry; and controlling speed of the drum based on a result of the determination, wherein the controlling the speed of the drum includes reperforming only the laundry wrapping operation when it is determined that the laundry is in the unbalanced state.

11. The control method according to claim 10, wherein the determining the unbalanced state of the laundry includes calculating a size of a reference duty during the acceleration of the drum to determine a difference between an actual duty applied to the motor and the reference duty, generating an unbalance determination signal from a minimum value of the difference between the actual duty and the reference duty to compare the unbalance determination signal to a predetermined unbalance limit value, and determining that the laundry is in the unbalanced state when the minimum value of the difference between the actual duty and the reference duty is less than the unbalance limit value.

* * * * *